United States Patent [19]

Kim

[11] Patent Number: 4,492,830

[45] Date of Patent: Jan. 8, 1985

[54] JOYSTICK WITH SINGLE-LEAF SPRING SWITCH

[75] Inventor: Syng N. Kim, Hoffman Estates, Ill.

[73] Assignee: Wico Corporation, Niles, Ill.

[21] Appl. No.: 479,317

[22] Filed: Mar. 28, 1983

[51] Int. Cl.[3] ..... H01H 19/00

[52] U.S. Cl. ..... 200/6 A; 200/153 X

[58] Field of Search ..... 200/6 A, 6 BB, 153 X, 200/17 R, 18, 5 A

[56] References Cited

U.S. PATENT DOCUMENTS

| | | | |
|---|---|---|---|
| 2,558,659 | 6/1951 | Mork | 200/17 R |
| 3,033,946 | 5/1962 | Meyer | 200/6 A |
| 3,056,867 | 10/1962 | Eitel | 200/6 A |
| 4,124,787 | 3/1977 | Aamoth et al. . | |
| 4,246,453 | 1/1981 | Marchese | 200/11 DA |
| 4,319,099 | 1/1981 | Asher . | |
| 4,349,708 | 9/1982 | Asher | 200/6 A |
| 4,382,166 | 5/1983 | Kim | 200/18 |
| 4,394,548 | 7/1983 | Dola | 200/6 A |
| 4,408,103 | 10/1983 | Smith | 200/6 A |

*Primary Examiner*—E. A. Goldberg
*Assistant Examiner*—M. J. Reinhart
*Attorney, Agent, or Firm*—Emrich & Dithmar

[57] ABSTRACT

A switch assembly is provided for mounting in the two-part housing of a joystick apparatus. The assembly includes a printed circuit board held between retainers on the two parts of the housing. A plurality of switches are mounted on the board, each including a fixed printed contact and a movable leaf spring contact, the leaf spring contacts being engageable with actuators on a tilt plate which is tiltably carried by the joystick handle for selective actuation of the switches. The board also carries a fire control switch including a printed contact and a leaf spring contact which is engageable with a push-button actuator on the joystick handle. The handle includes a support module therefor which is held in place by retaining pins on one of the two housing parts, the tilt plate having recesses therein for accommodating the retaining pins.

15 Claims, 6 Drawing Figures

JOYSTICK WITH SINGLE-LEAF SPRING SWITCH

BACKGROUND OF THE INVENTION

The present invention relates to a joystick controller for electric switches, of the type which is used for controlling the operation of certain electronic games and the like.

Prior joystick controllers typically include a housing enclosing a plurality of switches which may include, for example, direction control switches and a fire control switch, and handle means tiltably mounted on the housing for movement to actuate the direction control switches. The handle may include a push-button for actuating the fire control switch. The switches used in certain prior joystick controllers are leaf switches comprising a switch body molded around a pair of leaf spring switch blades. Discrete receptacles or sockets for the direction control switches are provided in the housing, and the switches are then interconnected by copper wires which are in turn interconnected to a control cable.

In order to minimize the wiring inside the housing, it is known to provide a printed circuit board in the housing on which are printed the interconnections among switches and one of the contacts for each switch. In such arrangements, the direction control switches are bubble or dome switches, wherein the movable switch contact is a resilient plate or membrane which is deflectable by an actuator into engagement with the printed contact. But such arrangements have relatively poor wear characteristics in that the resilient plate or membrane tends to wear out rapidly and/or have its resilience permanently altered with use, adversely affecting the sensitivity and reliability of the joystick controller.

SUMMARY OF THE INVENTION

The present invention relates to an improved joystick controller which avoids the disadvantages of prior controllers while affording additional structural and operating advantages.

It is a general object of this invention to provide a joystick controller of the type which utilizes a printed circuit board, which is characterized by rugged and long-wearing construction.

In connection with the foregoing object, it is another object of this invention to provide a joystick controller of the type set forth, which is of relatively simple and economical construction.

It is still another object of this invention to provide a joystick controller of the type set forth, which includes a modular handle support, and which provides accurate and immovable retention of the handle support and the circuit board in the associated housing, without interference with the operation of the switch actuator mechanism.

These and other objects of the invention are attained by providing a joystick controller including a housing and handle means tiltably mounted on the housing for actuating direction control switches in the housing, the improvement comprising: a printed circuit board having printed thereon a fixed contact of a direction control switch, resilient leaf spring contact means of the direction control switch mounted on the circuit board for movement between a normal open condition spaced from the fixed contact and a closed condition contacting the fixed contact, and actuator means disposed in the housing and responsive to tilting movement of the handle means for selectively moving the leaf spring contact means to the closed condition thereof.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 2:
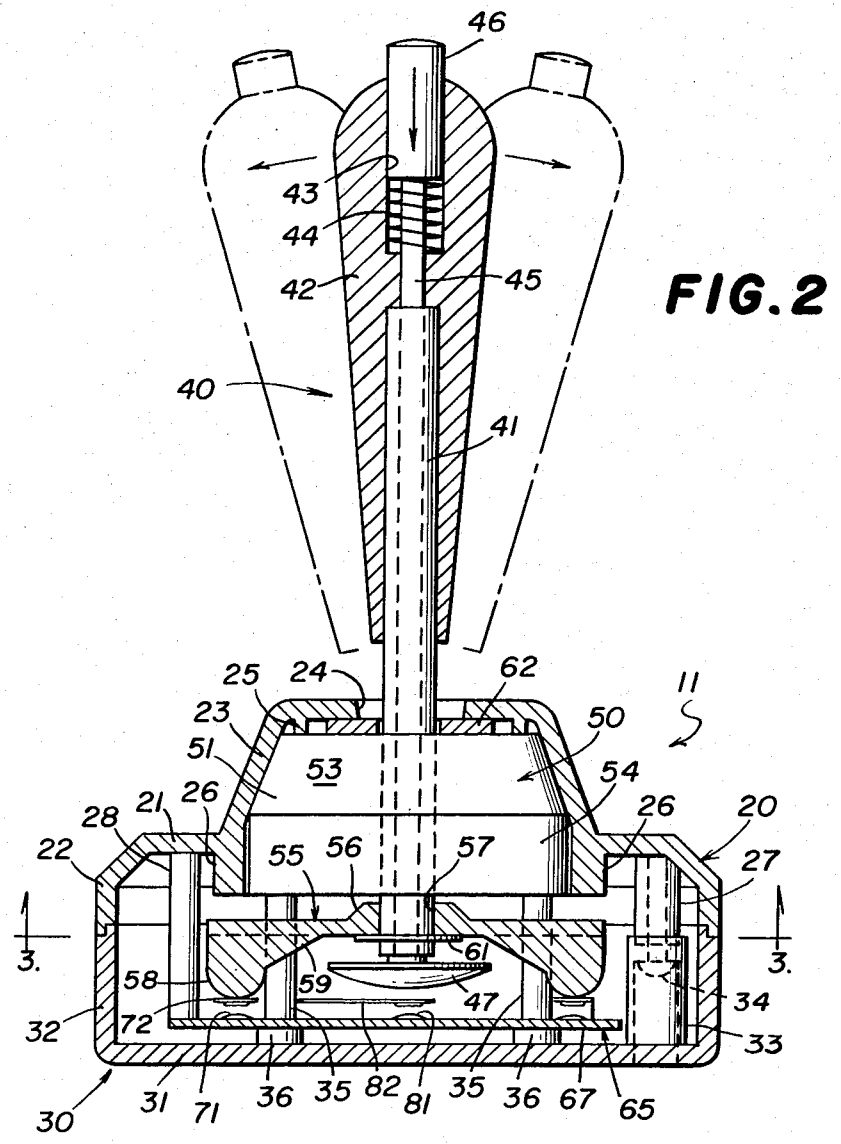
FIG. 2 is a view in vertical section taken along the line 2—2 in FIG. 1, and illustrating movement of the joystick handle.
Figure 1:
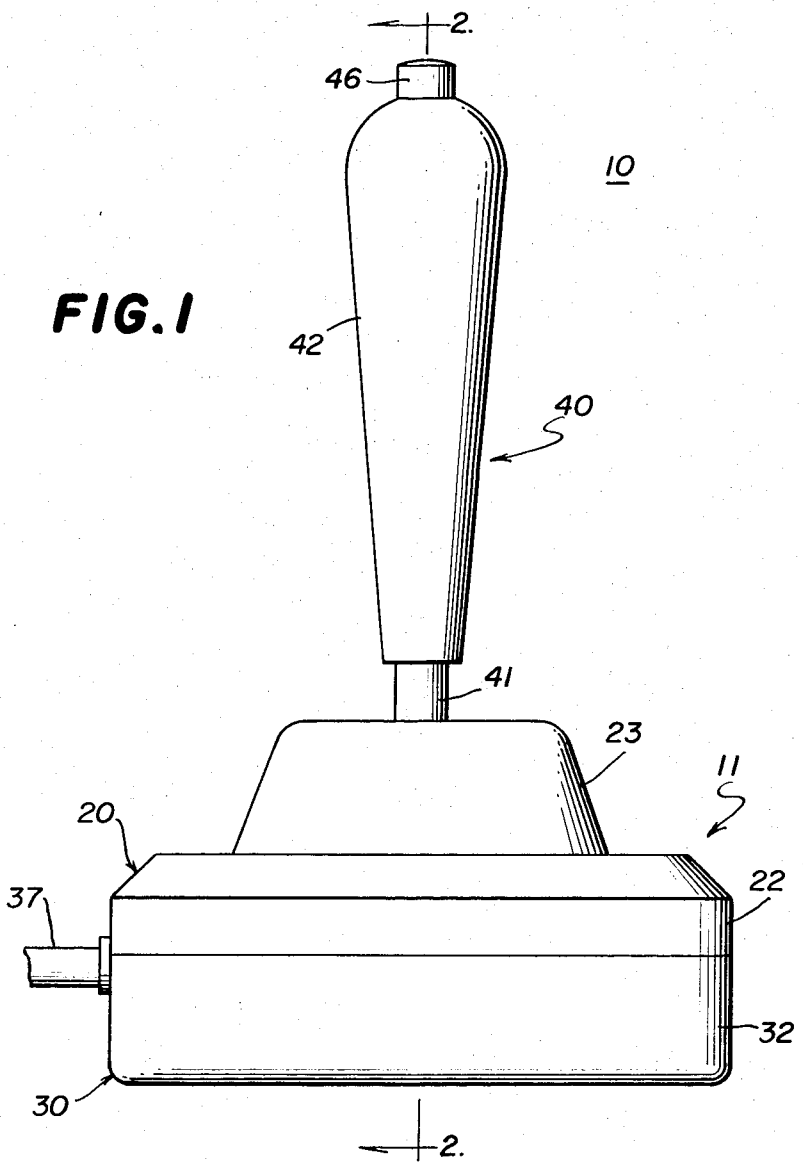
FIG. 1 is a side elevational view of a joystick controller incorporating a switch assembly constructed in accordance with and embodying the features of the present invention.

Referring now to FIGS. 1 through 4 of the drawings, there is illustrated a joystick controller, generally designated by the numeral 10. The joystick controller 10 has a two-part housing, generally designated by the numeral 11, which includes a cover or top 20 and a bottom 30 which cooperate to form a substantially closed housing. The cover 20 has a generally rectangular top wall 21 provided around the peripheral edges thereof with a continuous depending skirt or side wall 22. Integral with the top wall 21 centrally thereof and projecting upwardly therefrom is a turret 23 which may be generally frustoconical or frustopyramidal in shape, having a circular aperture 24 in the upper end thereof. Integral with the inner surface of the turret 23 and depending therefrom around the perimeter of the aperture 24 is a bearing rim 25. Integral with the top wall 21 at the junction thereof with the turret 23 and depending therefrom at equiangularly spaced apart points therealong are four retaining pins 26. Also integral with the top wall 21 and depending therefrom respectively adjacent with the four corners thereof are four attachment posts 27, each having an internally threaded bore extending axially into the distal end thereof. Also integral with the inner surface of the top wall 21 and depending therefrom below the lower edge of the skirt 22 are four retaining studs 28.

Figure 4:
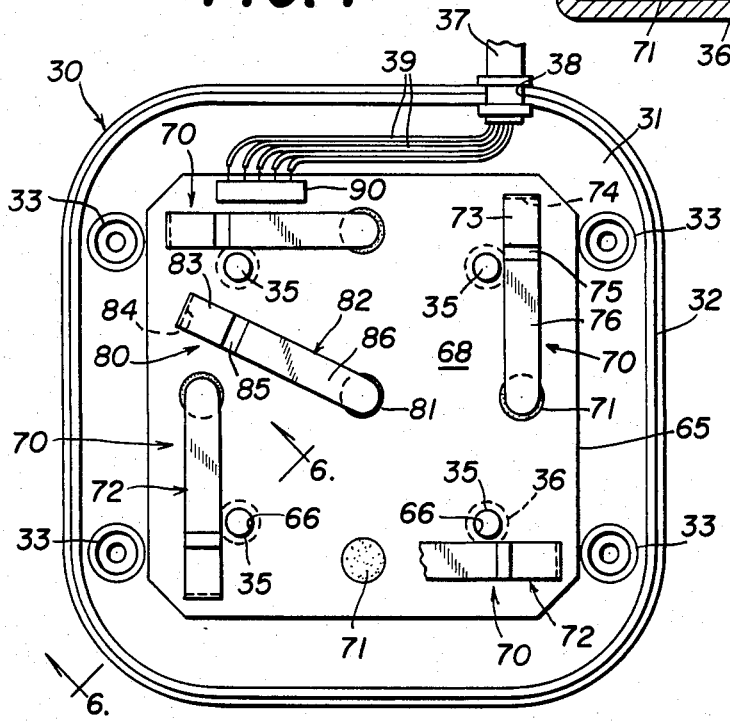
FIG. 4 is a plan view of the bottom of the joystick controller housing, with the cover and handle assembly removed.

The bottom 30 of the housing 11 includes a generally rectangular bottom wall 31 integral at the perimeter thereof with a continuous upstanding skirt or side wall 32. The edges of the skirts 22 and 32 of the cover 20 and bottom 30, respectively, are flanged for mating engagement with each other for cooperation to form a closed housing. Integral with the bottom wall 31 and projecting upwardly therefrom substantially normal thereto are four hollow attachment tubes 33, each being provided with a recess at the distal end thereof, the attachment tubes 33 being respectively disposed for alignment with the attachment posts 27 of the cover 20. More specifically, the distal ends of the attachment posts 27 are received in the recesses of the upper ends of the attachment tubes 33. Fasteners, such as screws 34, are received through the attachment tubes 33 from the lower ends thereof and are threadedly engaged with the attachment posts 27 securely to hold the cover 20 and the bottom 30 together in an assembled, closed configuration illustrated in FIGS. 1 and 2. Also integral with the bottom wall 31 and projecting upwardly therefrom beyond the upper edge of the skirt 32 are four positioning pins 35, each having an enlarged-diameter portion 36 at the junction thereof with the bottom wall 31. A cable 37 is received through a notch 38 in the skirt 32, the cable 37 including a plurality of wires 39 which are electrically connected to the circuitry of the joystick controller 10 in a manner to be described more fully below (FIG. 4).

Mounted on the cover 20 is a handle assembly, generally designated by the numeral 40, which includes an elongated cylindrical tube 41 extending through the aperture 24 and projecting outwardly well beyond the turret 23. Fixedly secured to the outer end of the tube 41 in surrounding relationship therewith is a handle 42 having a cylindrical recess 43 in the outer end thereof disposed coaxially with the tube 41. Seated in the recess 43 is a helical compression spring 44 which is disposed in surrounding relationship with an elongated rod 45 which extends through the tube 41 and projects a slight distance beyond the inner end thereof. The outer end of the rod 45 is fixedly secured to a push button 46 which is slidably received in the recess 43. The inner end of the rod 45 is fixedly secured to an actuator 47. It will be appreciated that the compression spring 44 acts on the push button 46 to urge the rod 45 to a normal rest position, illustrated in FIG. 2, wherein the actuator 47 is held against the lower end of the tube 41 and wherein the push button 46 projects outwardly beyond the outer end of the handle 42.

The joystick controller 10 also includes a support module 50 for the handle assembly 40, the construction of which is explained in greater detail in my copending application Ser. No. 436,678, the disclosure of which is incorporated herein by reference. The support module 50 has a cover 51 and a bottom 52 which cooperate to form a closed housing. The cover 52 is generally in the shape of an inverted cup having a circular end wall provided with a circular aperture therein centrally thereof, and integral around the perimeter thereof with a sloping side wall 53 having a depending skirt 54, generally rectangular in outline. The support module 50 includes a diaphragm assembly (not shown). The tube 41 extends through complementary coaxial openings in the cover 51 and bottom 52 and through the diaphragm assembly of the support module 50, the tube 41 being fixedly secured to the diaphragm assembly to provide a tiltable support for the handle assembly 40.

The support module 50 is dimensioned to fit within the turret 23 of the housing cover 20, with the upper end of the cover 51 seated against the bearing rim 25, and with the retaining pins 26 cooperating accurately to center the support module 50 in the turret 23. Fixedly secured to the tube 41 adjacent to the inner end thereof, beneath the support module 50, is a generally circular tilt plate 55 having a central hub portion 56 provided with a circular aperture 57 for receiving the tube 41. Integral with the tilt plate 55 and depending therefrom at equiangularly spaced apart points around the perimeter thereof are four actuators 58, generally triangular stiffening webs being provided along the bottom of the tilt plate 55 and extending radially inwardly from the inner sides of the actuators 58. Formed in the peripheral edge of the tilt plate 55 at equiangularly spaced apart points therealong are four arcuate notches or recesses 60, which alternate with the actuators 58, for a purpose to be explained more fully below. An E-ring 61 may be provided on the tube 41 to retain the tilt plate 55 thereon. Also, a washer 62 may be provided around the tube 41 between the top of the support module 50 and the inner surface of the top wall of the turret 23.

The joystick controller 10 also includes a generally rectangular printed circuit board 65 which is dimensioned to fit in the housing 11 substantially parallel to the bottom wall 31. The circuit board 65 has four circular holes 66 (FIG. 4) therein for respectively receiving therethrough the positioning pins 35. Thus, in use, the printed circuit board 65 is seated on the enlarged-diameter portions 36 of the positioning pins 35, with the printed side 67 thereof preferably facing the bottom wall 31 and with the component side 68 thereof facing upwardly.

Figure 5:
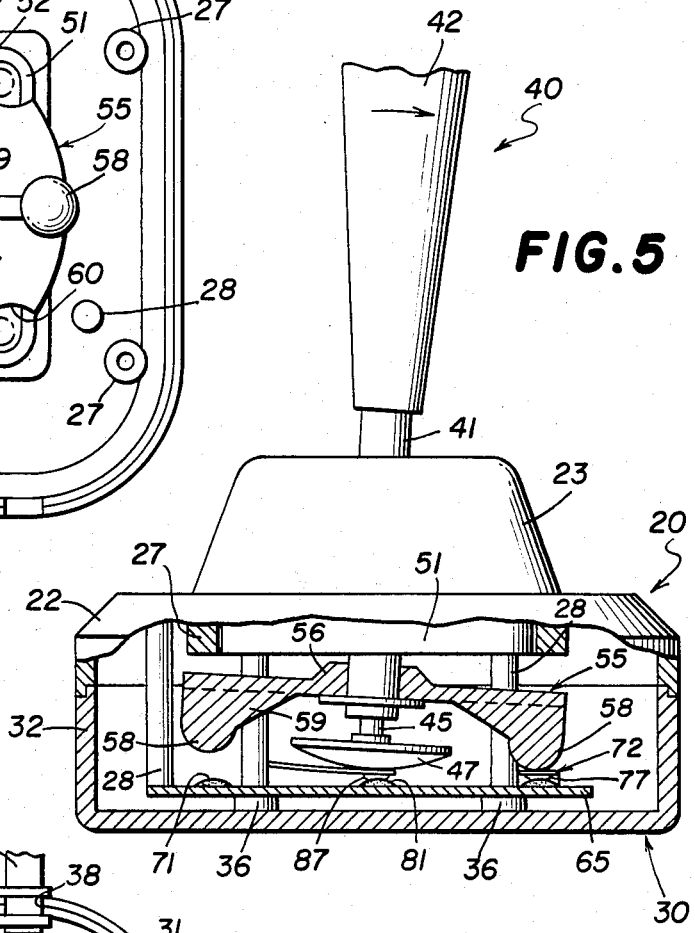
FIG. 5 is a fragmentary, side elevational view of the joystick controller, in partial vertical section, illustrating actuation of the switches.
Figure 6:
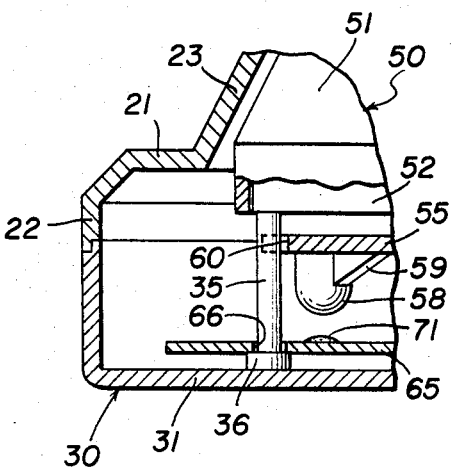
FIG. 6 is a fragmentary view in vertical section taken along the line 6—6 in FIG. 4.

Referring now also to FIGS. 5 and 6 of the drawings, there are mounted on the printed circuit board 65, four direction control switches, each generally designated by the numeral 70, the switches 70 being substantially identical in construction, wherefore only one will be described in detail. Each of the direction control switches 70 includes a fixed contact 71 which is printed on the component side 68 of the printed circuit board 65, and may be connected to the circuitry on the opposite side 67 of the circuit board 65 by a printed path through a complementary aperture (not shown) in the circuit board 65, in a well-known manner. The movable contact of the direction control switch 70 comprises a spring leaf, generally designated by the numeral 72, which includes a short, flat base 73 disposed against the component side 68 of the printed circuit board 65 and integral at one end thereof with a depending tab 74 which is received through a complementary slot in the printed circuit board 65 for connection, as by soldering, to the circuitry on the printed side 67 of the printed circuit board 65. Integral with the base 73 at the other end thereof and extending upwardly therefrom away from the printed circuit board 65 is an offset portion 75, which is in turn integral with an elongated, flexible, resilient arm 76 which extends substantially parallel to the printed circuit board 65 a predetermined distance thereabove. The arm 76 is provided adjacent to the distal end thereof with an embossed contact 77 (see FIG. 5) which projects downwardly toward the fixed contact 71 and is centered thereover.

Also mounted on the printed circuit board 65 is a fire control switch, generally designated by the numeral 80, which includes a fixed contact 81 printed on the component side 68 of the printed circuit board 65 centrally thereof, and a movable contact comprising an elongated spring leaf 82. The spring leaf 82 includes a flat base 83 disposed against the component side 68 of the printed circuit board 65, and being integral at one end thereof with a depending tab 84 which extends through a complementary slot (not shown) in the printed circuit board 65 for connection, as by soldering, to the printed circuitry on the opposite side thereof, in a well known manner. Integral with the base 83 at the other end thereof and projecting upwardly therefrom away from the printed circuit board 65 is an offset portion 85, which is in turn integral with an elongated, flexible, resilient arm 86 which extends parallel to the printed circuit board 65 a predetermined distance thereabove. Integral with the arm 86 adjacent to the distal end thereof is an embossed contact 87 (see FIG. 5) which depends therefrom toward the fixed contact 81 and is centered thereover. Also mounted on the printed circuit board 65 is a plug-type connector 90 which is connected, as by soldering, to the printed circuit on the circuit board 65 and is also connected to the wires 39 of the cable 37.

In assembly of the joystick controller 10, the support module 50 is first disposed in the turret 23 and the tube 41 of the handle assembly 40 is extended therethrough. The tilt plate 55 and the actuator 47 are then mounted in place on the handle assembly 40. The printed circuit board 65 is disposed in the bottom 30 of the housing 11 over the positioning pins 35, the printed circuit board 65 being dimensioned to fit inside the attachment tubes 33, as illustrated in FIG. 4. The cable 37 is then connected to the plug-type connector 90. The cover 20 and bottom 30 of the housing 11 are then assembled together.

Figure 3:
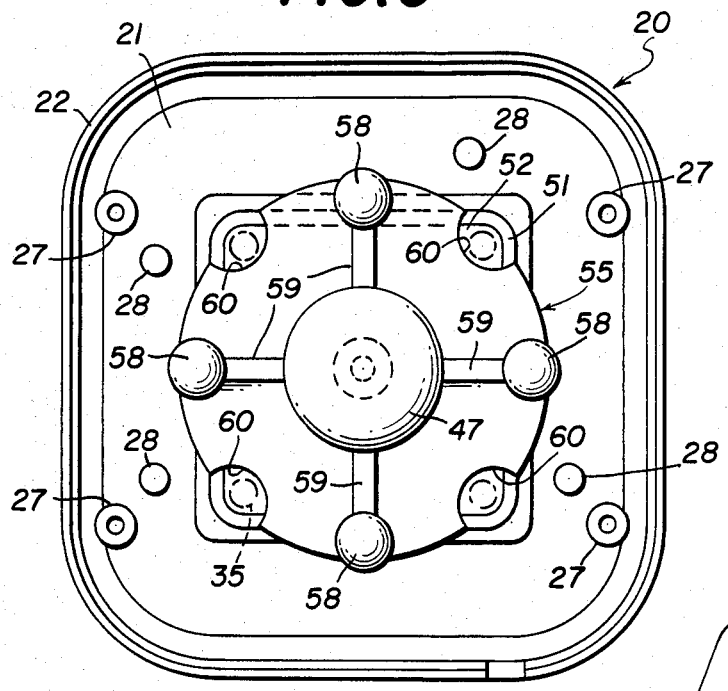
FIG. 3 is a view in horizontal section taken along the line 3—3 in FIG. 2.

The tilt plate 55 is so positioned and oriented with respect to the support module 50, that the notches 60 are respectively disposed toward the corners of the support module 50, as best illustrated in FIG. 3. Thus, when the cover 20 is assembled with the bottom 30, the actuators 58 will respectively be disposed immediately above the distal ends of the arms 76 of the direction control switches 70, and the actuator 47 will be disposed immediately above the distal end of the arm 86 of the fire control switch 80. When the housing 11 is assembled in its closed condition illustrated in FIGS. 1, 2, 5 and 6, the positioning pins 35 respectively extend up through the notches 60 in the tilt plate 55 and bear against the bottom 52 of the support module 50, respectively adjacent to the corners thereof, for cooperation with the bearing rim 25 immovably to hold the support module 50 in place. The retaining studs 28 will bear against the component side 68 of the printed circuit board 65 for cooperation with the positioning pins 35 and the enlarged-diameter portions 36 thereof immovably to hold the printed circuit board 65 in place. The fasteners 34 are then applied securely to lock the cover 20 and bottom 30 together.

In operation, as the handle assembly 40 is tilted, as indicated in FIGS. 2 and 5, one or more of the actuators 58 will engage the arm 76 of the corresponding direction control switch 70, deflecting the arm 76 inwardly toward the printed circuit board 65 for bringing the embossed contact 77 into engagement with the fixed contact 71 to close the direction control switch 70. When the handle assembly 40 is returned to its normal, upright rest position, the arm 76 of the direction control switch 70 returns by its own resilience to its normal rest position for reopening the direction control switch 70. The fire control switch 80 is closed by depression of the push-button 46 in a known manner for moving the actuator 47 into engagement with the arm 86 of the fire control switch 80, deflecting it downwardly for moving the embossed contact 87 into engagement with the fixed contact 81. Upon release of the push-button 46, the arm 86 springs back to its normal rest position for reopening the fire control switch 80.

It will be appreciated that the switch arrangement of the present invention permits the use of a printed circuit board and its attendant advantages of a minimal number of parts and simple assembly, while also achieving the ruggedness and long-wearing characteristics of leaf spring switches, all in a simple and economical construction.

I claim:

1. In a joystick controller including a housing and handle means tiltably mounted on the housing for actuating direction control switches in the housing, the improvement comprising: a printed circuit board having an aperture therethrough and having printed thereon a fixed contact of a direction control switch, a single resilient leaf spring contact member of the direction control switch mounted on said circuit board for movement between a normal open condition spaced from said fixed contact and a closed condition contacting said fixed contact, said leaf spring contact member having a tab projecting therefrom and disposed through said aperture for connection to circuitry on the opposite side of said circuit board, and actuator means disposed in the housing spaced from said printed circuit board and responsive to tilting movement of the handle means for directly engaging and selectively moving said leaf spring contact member to the closed condition thereof.

2. The joystick controller of claim 1, including a plurality of the direction control switches.

3. The joystick controller of claim 1, and further including a fire control switch comprising a second fixed contact printed on said circuit board and second resilient leaf spring contact means mounted on said said circuit board for movement between a normal open condition spaced from said second fixed contact and a closed condition contacting said second fixed contact, and auxiliary actuator means for selectively moving said second leaf spring contact means to the closed condition thereof.

4. The joystick controller of claim 1, wherein said leaf spring contact member is movable toward and away from the plane of said printed circuit board.

5. The joystick controller of claim 1, wherein said resilient leaf spring contact member comprises a base portion fixedly secured to said printed circuit board and an offset portion integral with said base portion and extending therefrom away from said printed circuit board, and an elongated flexible arm integral with said offset portion and extending therefrom substantially parallel to said printed circuit board and spaced a predetermined distance therefrom.

6. The joystick controller of claim 5, wherein said actuator means comprises a tilt plate fixedly carried by said handle means and tiltable therewith, and an actuator projection disposed on said tilt plate for engagement with said elongated flexible arm.

7. The joystick controller of claim 5, wherein said base portion of said leaf spring contact member comprises a flat portion disposed in parallel engagement with said printed circuit board.

8. The joystick controller of claim 5, wherein said elongated arm has a contact projection adjacent to the distal end thereof extending toward said fixed contact for engagement therewith in the closed condition of said leaf spring contact member.

9. The joystick controller of claim 1, and further including a support module disposed in the housing for tiltably supporting the handle means, the housing including retaining means engageable with said support module for retaining it in place, said actuator means comprising a tilt plate fixedly carried by said handle shaft for tilting therewith, said tilt plate having recesses therein for accommodating said retaining means thereby to permit tilting movement of said tilt plate without interference by said retaining means.

10. In a joystick controller including a housing and handle means for actuating direction control switches in the housing, the improvement comprising: a support module disposed within the housing for tiltably supporting the handle means, retaining means carried by the housing and engageable with said support module for immovably holding said support module in place, and a tilt plate fixedly mounted on said handle means between said support module and the direction control switches and tiltable with said handle means for actuation of the direction control switches, said tilt plate having recesses formed therein for accommodating said retaining members thereby to permit tilting of said tilt plate without interference by said retaining members.

11. The joystick controller of claim 10, wherein the housing is a two-part housing including a cover and a base matable to define an enclosure, said support module being disposed in said cover and said retaining members being carried by said base.

12. The joystick controller of claim 11, wherein said retaining members comprise a plurality of pins integral with said base and projecting therefrom toward said cover.

13. The joystick controller of claim 10, and further including a printed circuit board disposed in said housing and carrying the direction control switches thereon.

14. The joystick controller of claim 13, wherein said printed circuit board has a plurality of openings therein for respectively receiving said retaining members therethrough.

15. The joystick controller of claim 14, and further including board retaining means carried by said housing and cooperating with said retaining members for immovably holding said printed circuit board in place.

* * * * *